US005203314A

United States Patent [19]

Green

[11] Patent Number: 5,203,314

[45] Date of Patent: Apr. 20, 1993

[54] ARCHER'S AID FOR DRAWING BOWSTRING

[76] Inventor: William H. Green, 527 Clarks Run Rd., La Plata, Md. 20646

[21] Appl. No.: 803,064

[22] Filed: Dec. 6, 1991

[51] Int. Cl.[5] ..... F41B 5/18

[52] U.S. Cl. ..... 124/35.2; 124/1; 124/86; 482/124

[58] Field of Search ..... 124/23.1, 25.6, 80, 124/86, 88, 90, 1, 35.2; 482/121, 124, 125

[56] References Cited

U.S. PATENT DOCUMENTS

| | | | |
|---|---|---|---|
| 2,097,376 | 10/1937 | Marshman | 482/124 |
| 3,072,115 | 1/1963 | Johnson | 124/35.2 |
| 4,041,926 | 8/1977 | Troncoso et al. | 124/35.2 |
| 4,458,659 | 7/1984 | Troncoso | 124/35.2 |
| 4,911,439 | 3/1990 | Kuhl | 482/124 |
| 4,993,705 | 2/1991 | Tolle | 482/124 |
| 5,020,508 | 6/1991 | Greene | 124/35.2 |

FOREIGN PATENT DOCUMENTS

| | | | |
|---|---|---|---|
| 451516 | 8/1936 | United Kingdom | 482/124 |

*Primary Examiner*—Andrew V. Kundrat
*Assistant Examiner*—John Ricci
*Attorney, Agent, or Firm*—Laurence R. Brown

[57] ABSTRACT

To alleviate the problem that a considerable amount of force is required by an archer to bend the bow by pulling or drawing the bowstring, this invention introduces an auxiliary force aid to supplement the manual force of the archer's arm for drawing the bowstring. Thus, an elastic member anchored to the archer's body is stretched to store a force when the archer's arm reaches for the bowstring to draw it, and the stored force from the stretched elastic member supplements the manual force provided by the archer's arm in a vectorial direction for drawing the bowstring thereby to make the drawstring easier to draw. The elastic member, typically a bungee cord, is affixed to a body harness held on the upper torso by a shoulder strap for movement and stretching along the line of travel of the archer's hand when reaching for the bowstring to draw it. Thus, the peak drawing force exerted by the archer is reduced by distributing it over the reciprocal reaching and drawing motions of the archer's arm.

6 Claims, 1 Drawing Sheet

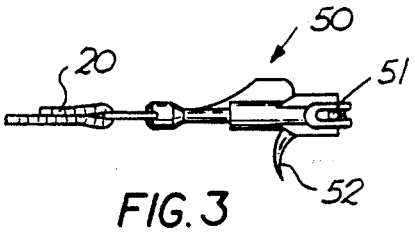
FIG. 3
FIG. 4
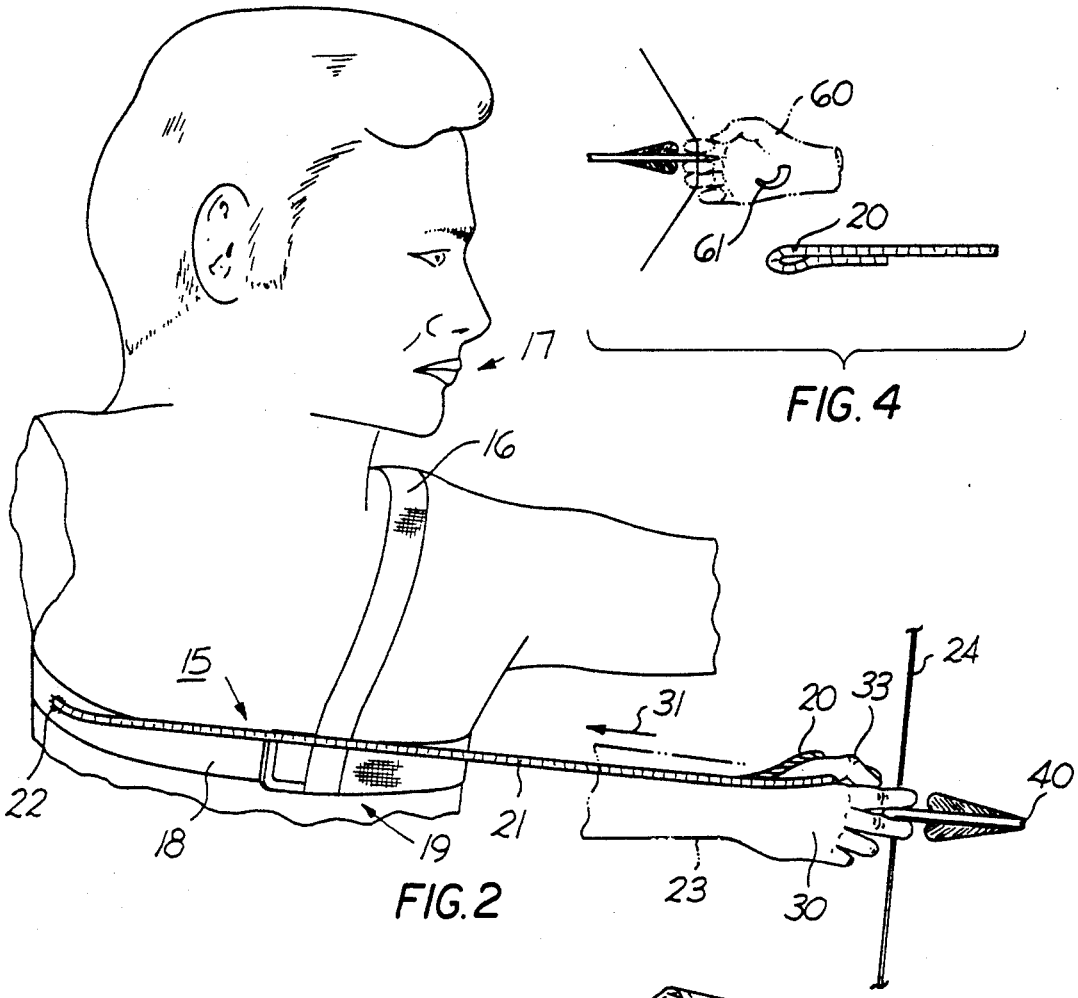
FIG. 2
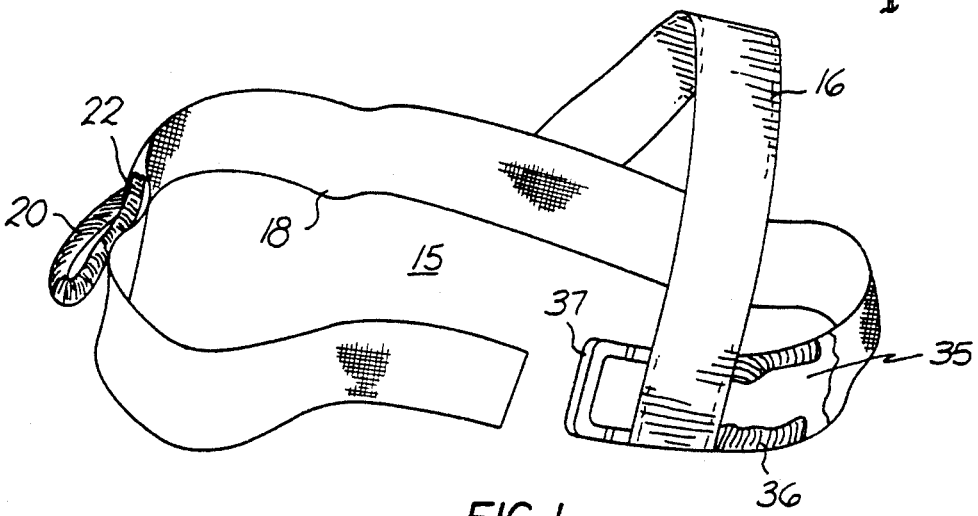
FIG. 1

ARCHER'S AID FOR DRAWING BOWSTRING

TECHNICAL FIELD

This invention relates to archery, and more particularly it relates to apparatus for and methods of drawing bowstrings.

BACKGROUND ART

The drawing of a bowstring requires a significant force threshold to overcome the bow resistance to the initial movement induced by the bowstring. This threshold force can put substantial stress upon the drawing arm of the archer and furthermore can interfere with the smooth motion cycle desired in drawing the bowstring to release the arrow for a desired shot. The problem is particularly acute in high powered hunting bows which gain their power from stiffer bows. Also shooting with target bows requires consistent accuracy and precision, which may become affected by extraordinary manual stress or changes in manual strength or feel resulting from arm fatigue. There is no satisfactory known solution to this problem provided in the prior art. Nor is there any way known in the prior art for permitting an archer to draw a stronger bow than possible with a conventional drawing stroke.

There are different kinds of mechanical aids to assist archers known in the art. Those, which can be adopted during a shooting cycle rather than for off-line practice of rhythm, etc., are critically dependent upon the functioning of the aids in the procedural events of a shooting cycle. For example, if hunting game or shooting at targets, accuracy is critically dependent upon an uninterrupted rhythmic shooting cycle where the bowstring is drawn and the arrow is released.

It is therefore an objective of this invention to provide methods and apparatus for reducing the peak force required by an archer to draw bowstrings.

It is an accompanying objective of this invention to provide methods and apparatus that will permit an archer to use stronger bows.

Another important objective is to provide improvements for aiding an archer to draw bowstrings operable in a manner that does not interfere with the archer's rhythm for a shooting cycle with a bow or accuracy of aim.

DISCLOSURE OF THE INVENTION

This invention reduces the peak manual force required to draw a bowstring by introducing an auxiliary source of force for overcoming the bowstring draw threshold thereby to reduce arm fatigue or manual failure accompanying the draw in a fashion that does not interfere with good bowmanship, accuracy and precision. Coordination in applying the auxiliary force to the bowstring during the shooting cycle with proper timing and motion at the instant of drawing is achieved by using the drawing arm to control the application and release of the auxiliary force. Significantly the auxiliary force is manually generated in a manner that significantly reduces the peak forces that must be delivered manually for overcoming the bowstring draw threshold. Thus, the manual threshold force is shared during manual forward and return strokes to produce a total peak force necessary at the instant of drawing to overcome the bow threshold and initiate the bending of the bow.

In a preferred embodiment of the invention a body mounted harness is provided for anchoring one end of a stretchable elastic storage medium, in the form of a bungee cord, for example. This cord is then grasped with the hand on the arm drawing the bow and stretched in a forward arm stroke to store the elastic force of the cord as the arm is straightened out to reach the bowstring. Thus, both the manual muscular force exerted by the arm in drawing the bowstring and the auxiliary force stored in the bungee cord are available in tandem for overcoming the force threshold to break the bow away from its resident posture to start the bowstring into motion. The bungee cord is then returned to its non-stretched resident position when the bowstring is drawn and the shot is taken without interference of the bungee cord with the normal proper triggering of the arrow into flight.

Other features, objectives and advantages of the invention will be found throughout the following description, claims and accompanying drawing.

BRIEF DESCRIPTION OF THE DRAWINGS

In the accompanying drawing wherein like reference characters indicate similar features throughout the various views to facilitate comparison:

FIG. 1 is a perspective sketch of an archer's harness afforded by this invention to provide an auxiliary force available when drawing the bowstring;

FIG. 2 is a sketch, partially broken away of an archer reaching the bowstring just before drawing it, while wearing apparatus provided by this invention for reducing the peak manual force required to draw the bowstring;

FIG. 3 is a fragmental sketch of a harness assembly coupled with a bow release mechanism in accordance with this invention;

FIG. 4 is a fragmental exploded view sketch showing an archer's glove with a hook for receiving the elastic cord provided by this invention to reduce the manual force required to draw the bowstring; and accompanying elastic cord of this invention ready for connection onto the hook disposed upon the archer's glove afforded by this embodiment of the invention.

THE PREFERRED EMBODIMENTS

With reference to FIGS. 1 and 2, it is seen that a body harness 15, with shoulder strap 16, fits an archer 17 so that a band 18 fits about the upper torso 19 with a looped end 20 of an elastic bungee cord 21 extendable from a slot 22 from the interior of the band 18 positioned just under the armpit of the arm 23 that reaches to draw the bowstring 24. Thus, the stretched bungee cord 21 lies in a position substantially parallel to the extended arm 23 reaching for the bowstring 24 to exert upon the bowstring 24 by medium of the hand 30 a force in the direction of the arrow 31 of a vectorial direction assisting the pull of the archer's arm 23 for drawing the bowstring 24. The end loop 20 of the bungee cord 21 in this embodiment is wrapped about the archer's thumb 33.

It can be seen therefore that the archer by manual effort stretches the bungee cord 21 when he reaches for the bowstring. Typically this elastic bungee cord 21 is a fabric material type of elastic spring such as those commercially available items used for fastening sailboat covers, for example. For the disclosed purpose, typically, a 36 inch (0.9 m) long cord having a diameter of about 3/16 inch (4.8 mm) exerting an initial force of about 25 pounds (11.3 kg) is provided. Thus, an assisting force of this magnitude is available in the direction of the arrow 31 for aiding the archer 17 to draw the bowstring 24. This mode of operation thus distributes the peak load force of drawing the bowstring between the reaching forward armstroke and the return draw stroke, thus substantially reducing the manual draw force required by the archer's arm 23. This either reduces fatigue so that the archery is improved or permits the archer to use a stronger bow that otherwise could not be drawn accurately for a good shot without disturbing the rhythm necessary for consistency and accuracy of aim.

The band 18 is typically a length of hollow fabric, preferably tubular nylon, such as used in mountain climbing gear, which accommodates the bungee cord 21 thereinside in relaxed stable state as shown in FIG. 1, with the freedom to stretch outwardly from slot 22 as shown in FIG. 2. As shown at broken away section 35 of band 18, the internal end 36 of bungee cord 21 is stitched or buttoned for adjustment, to the nylon tubing. Similarly the shoulder strap 16 is stitched to the band 18, in a manner that does not interfere with the stretching of the cord 21. A conventional belt buckle arrangement, or hook and loop type fastening 37 permits adjustment of the length of the band 18 by the archer. Different models may be made for children, women and men, for example, with different strength bungee cords, or adjustable attachments of #18.

Thus, there is afforded by this invention, a method of drawing a bowstring comprising the steps of stretching an elastic member anchored to an archer's body with an archer's arm reaching for the bowstring to draw it thereby to store a force on a forward stroke of the arm for supplementing manual force supplied by the archer's arm during a return stroke to draw the bowstring, and drawing the bowstring with the dual force components of the stretched elastic member and the manual force in the arm grasping the bowstring. Apparatus provided by the invention for assisting an archer in drawing a bowstring typically comprises an elastic member adapted to be extended elastically by an archer's arm when reaching to draw a bowstring, means for anchoring the elastic member to the archer's body to be disposed in a position substantially parallel with the archer's arm when grasping the bowstring for drawing it, and means for grasping the elastic member with a hand of the archer for elastic extension of the elastic member to store energy for assisting the archer to draw the bowstring.

The method of reducing the peak manual force exerted by an archer to draw a bowstring is effected by providing a force storage device in a position for storing force manually by a forward stroke of an archer's arm when reaching for a bowstring, exerting a part of the force required to draw the bowstring in extension of an archer's arm when reaching for a bowstring for storage in said device, and drawing the bowstring by combining the force stored in the storage device with a manual force of the archer's arm. It is important to note that the archer's aid of this invention is in effect isolated from the archer's arm when the bowstring is drawn to prevent interference with manual procedure in releasing an arrow with the drawn bowstring because the bungee cord 21 is relaxed in the stable state as shown in FIG. 1, and thus does not introduce significant forces nor impediment in the aiming and release of the arrow 40 when a shot is aimed and fired. Thus, the archer can use the invention without interfering with the consistency of the rhythm of the archer in the draw, aim and shoot cycle. Conversely when target practicing with frequent shots, the reduction of fatigue of the arm 23 can improve aiming accuracy and rhythm.

In the embodiment of FIG. 3, the free end 20 of the elastic cord 21 is attached to a mechanical bow release mechanism 50 operable at 51 to retain the bowstring until release by the trigger 52. This mechanism 50 is grasped, attached to the bowstring and used to draw the bowstring in the normal manner, except for the use of the elastic cord 21 for the purposes of this invention.

In the embodiment of FIG. 4, the archer's glove 60 is provided with a hook 61 over which the loop 20 of the elastic cord is hooked, or equivalent connection device.

It is therefore seen that this invention provides significant advantages to the archer in reducing fatigue, improving accuracy and working with stronger bows in a manner not heretofore available in the art. Accordingly those novel features descriptive of the spirit and nature of this invention are set forth with particularity in the appended claims.

I claim:

1. Apparatus for assisting an archer to draw a bowstring, comprising in combination, a harness constructed with means for supporting it upon the upper torso of an archer, an elastic cord affixed to the harness with one end disposed for grasping and stretching by a hand of the archer when attempting to draw the bowstring, the cord being adapted for elastically extending away from the harness to a position alongside a drawing arm in response to manual force of the archer's arm reaching for a bowstring, thereby to store energy in the cord in a vectorial direction for exerting a drawing force on the bowstring, thereby to aid the archer by supplementing the manual energy of the arm for breaking the bow and drawing the bowstring, an archer's glove, and mating fittings on the glove and elastic cord for attaching the cord to the glove.

2. Apparatus for assisting an archer to draw a bowstring, comprising in combination, a harness constructed with means for supporting it upon the upper torso of an archer, an elastic cord affixed to the harness with one end disposed for grasping and stretching by a hand of the archer when attempting to draw the bowstring, the cord being adapted for elastically extending away from the harness to a position alongside a drawing arm in response to manual force of the archer's arm reaching for a bowstring, thereby to store energy in the cord in a vectorial direction for exerting a drawing force on the bowstring, thereby to aid the archer by supplementing the manual energy of the arm for breaking the bow and drawing the bowstring, and a mechanical bow release affixed to the elastic cord for coupling to the bowstring.

3. Apparatus for assisting an archer to draw a bowstring, comprising in combination, a harness constructed with means for supporting it upon the upper torso of an archer, an elastic cord affixed to the harness with one end disposed for grasping and stretching by a hand of the archer when attempting to draw the bowstring, the cord being adapted for elastically extending away from the harness to a position alongside a drawing arm in response to manual force of the archer's arm reaching for a bowstring, thereby to store energy in the cord in a vectorial direction for exerting a drawing force on the bowstring, thereby to aid the archer by supplementing the manual energy of the arm for breaking the bow and drawing the bowstring, wherein the harness further comprises a torso strap of hollow fabric, a shoulder strap affixed to the torso strap for extending over one shoulder for positioning the torso strap near armpits of the archer, and the elastic cord further comprises a fabric material resident inside and stitched to the torso strap and emerging therefrom near the armpit at a side of the archer opposite the shoulder strap.

4. The method of drawing a bowstring comprising the steps of stretching an elastic member anchored to an archer's body with an archer's arm reaching for the bowstring to draw it thereby to store a force on a forward stroke of the arm for supplementing manual force supplied by the archer's arm during a return stroke to draw the bowstring, and drawing the bowstring with the dual force of the stretched elastic member and the manual force in the arm coupled to the bowstring.

5. The method of reducing the peak manual force exerted by an archer to draw a bowstring, comprising the steps of:

providing a force storage device in a position for storing force manually by a forward stroke of an archer's arm when reaching for a bowstring, exerting a part of the force required to draw the bowstring in extension of an archer's arm when reaching for a bowstring for storage in said device, and drawing the bowstring by combining the force stored in the storage device with a manual force of the archer's arm.

6. The method of claim 5 further comprising the step of isolating force from the storage device from the archer's arm when the bowstring is drawn to prevent interference with manual procedure in releasing an arrow with the drawn bowstring.

* * * * *